US011145446B2

(12) United States Patent
Takatani et al.

(10) Patent No.: US 11,145,446 B2
(45) Date of Patent: Oct. 12, 2021

(54) GRAIN-ORIENTED ELECTRICAL STEEL SHEET

(71) Applicant: NIPPON STEEL CORPORATION, Tokyo (JP)

(72) Inventors: Shinsuke Takatani, Tokyo (JP); Shunsuke Okumura, Tokyo (JP); Shohji Nagano, Tokyo (JP); Takashi Kataoka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/628,983

(22) PCT Filed: Jul. 13, 2018

(86) PCT No.: PCT/JP2018/026623
§ 371 (c)(1),
(2) Date: Jan. 6, 2020

(87) PCT Pub. No.: WO2019/013354
PCT Pub. Date: Jan. 17, 2019

(65) Prior Publication Data

US 2020/0176156 A1 Jun. 4, 2020

(30) Foreign Application Priority Data

Jul. 13, 2017 (JP) ..... JP2017-137433

(51) Int. Cl.
*H01F 1/147* (2006.01)
*C22C 38/20* (2006.01)
*C22C 38/34* (2006.01)

(52) U.S. Cl.
CPC ..... *H01F 1/147* (2013.01); *C22C 38/20* (2013.01); *C22C 38/34* (2013.01)

(58) Field of Classification Search
CPC ..... H01F 1/14783; H01F 1/147; H01F 1/18; C21D 2201/05; C21D 8/1222;
(Continued)

(56) References Cited

U.S. PATENT DOCUMENTS 3,856,568 A 12/1974 Tanaka et al.
5,961,744 A * 10/1999 Yamazaki ..... C21D 8/1288 148/113

(Continued)

FOREIGN PATENT DOCUMENTS

EP 0 565 029 A1 10/1993
EP 2540844 A1 1/2013

(Continued)

OTHER PUBLICATIONS

International Search Report for PCT/JP2018/026623 (PCT/ISA/210) dated Sep. 25, 2018.

(Continued)

*Primary Examiner* — Jenny R Wu
(74) *Attorney, Agent, or Firm* — Birch, Stewart, Kolasch & Birch, LLP

(57) ABSTRACT

A grain-oriented electrical steel sheet includes: a steel sheet; an oxide layer including $SiO_2$ that is formed on the steel sheet; and a tension-insulation coating that is formed on the oxide layer, in which the steel sheet includes, as a chemical composition, by mass %, C: 0.085% or less, Si: 0.80% to 7.00%, Mn: 1.00% or less, acid-soluble Al: 0.065% or less, S: 0.013% or less, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, the tension-insulation coating includes a chromium compound, and the Fe content in the oxide layer and the tension-insulation coating is 70 mg/m$^2$ to 250 mg/m$^2$.

2 Claims, 1 Drawing Sheet

(58) Field of Classification Search
CPC .. C21D 8/1233; C21D 8/1266; C21D 8/1272; C21D 9/46; C22C 38/001; C22C 38/002; C22C 38/008; C22C 38/02; C22C 38/04; C22C 38/06; C22C 38/08; C22C 38/12; C22C 38/14; C22C 38/16; C22C 38/20; C22C 38/34; C22C 38/60; C23C 22/00
See application file for complete search history.

(56) References Cited

U.S. PATENT DOCUMENTS

| | | | |
|---|---|---|---|
| 7,942,982 | B2 | 5/2011 | Kubo et al. |
| 9,574,249 | B2 | 2/2017 | Omura et al. |
| 2009/0047537 | A1 | 2/2009 | Nanba et al. |
| 2012/0312423 | A1 | 12/2012 | Murakami et al. |
| 2014/0338794 | A1* | 11/2014 | Shingaki ..... C22C 38/001 148/111 |
| 2016/0319390 | A1 | 11/2016 | Imamura et al. |

FOREIGN PATENT DOCUMENTS

| | | | |
|---|---|---|---|
| EP | 2757165 | A1 | 7/2014 |
| EP | 2902509 | A1 | 8/2015 |
| EP | 2940160 | A1 | 11/2015 |
| JP | 48-39338 | A | 6/1973 |
| JP | 6-65753 | A | 3/1994 |
| JP | 6-184762 | A | 7/1994 |
| JP | 7-278670 | A | 10/1995 |
| JP | 7-278833 | A | 10/1995 |
| JP | 8-269573 | A | 10/1996 |
| JP | 9-143583 | A | 6/1997 |
| JP | 11-106827 | A | 4/1999 |
| JP | 11-118750 | A | 4/1999 |
| JP | 2002-322566 | A | 11/2002 |
| JP | 2002-348643 | A | 12/2002 |
| JP | 2002-363763 | A | 12/2002 |
| JP | 2003-268450 | A | 9/2003 |
| JP | 2003-293149 | A | 10/2003 |
| JP | 2003-313644 | A | 11/2003 |
| JP | 2009-228117 | A | 10/2009 |
| JP | 2010-40666 | A | 2/2010 |
| JP | 5739840 | B2 | 6/2015 |
| KR | 10-2012-0118504 | A | 10/2012 |
| WO | WO 2010/013109 | A1 | 2/2010 |

OTHER PUBLICATIONS

JIS C 2550-1, "Test methods for electrical steel strip and sheet", (2011), total of 114 pages.
Written Opinion of the International Searching Authority for PCT/JP2018/026623 (PCT/ISA/237) dated Sep. 25, 2018.
Indian Office Action, dated May 6, 2020, for counterpart Indian Application No. 202017000428, with an English translation.

* cited by examiner

GRAIN-ORIENTED ELECTRICAL STEEL SHEET

TECHNICAL FIELD OF THE INVENTION

The present invention relates to a grain-oriented electrical steel sheet that is used as an iron core material of a transformer and particularly relates to a grain-oriented electrical steel sheet having excellent coating adhesion.

Priority is claimed on Japanese Patent Application No. 2017-137433, filed on Jul. 13, 2017, the content of which is incorporated herein by reference.

RELATED ART

A grain-oriented electrical steel sheet is used mainly in a transformer. A transformer is continuously excited over a long period of time from installation to disuse such that energy loss continuously occurs. Therefore, energy loss occurring when the transformer is magnetized by an alternating current, that is, iron loss is a main parameter that determines the performance of the transformer.

In order to reduce iron loss of a grain-oriented electrical steel sheet used in a transformer, various methods have been developed. Examples of the methods include a method of highly aligning grains in the {110}<001> orientation called Goss orientation, a method of increasing the amount of a solid solution element such as Si that increases electric resistance, and a method of reducing the thickness of a steel sheet. In addition, it is known that a method of applying tension to a steel sheet is effective for reducing iron loss.

In order to apply tension to a steel sheet, it is effective to form a coating made of a material having a lower thermal expansion coefficient than the steel sheet on a steel sheet at a high temperature. In a final annealing process, a forsterite film formed in a reaction of an oxide on a steel sheet surface and an annealing separator can apply tension to the steel sheet, and thus also has excellent adhesion (coating adhesion) with the steel sheet.

Patent Document 1 discloses a method in which an insulation coating is formed by baking a coating solution including colloidal silica and a phosphate as main components. This method has a high effect of applying tension to a steel sheet and is effective for reducing iron loss. Accordingly, a method of forming an insulating coating including a phosphate as a main component in a state where such a forsterite film formed in a final annealing process remains is a general method of manufacturing a grain-oriented electrical steel sheet.

On the other hand, recently, it has been clarified that the forsterite film inhibits a domain wall motion and adversely affects iron loss. In a grain-oriented electrical steel sheet, a magnetic domain changes depending on a domain wall motion in an alternating magnetic field. In order to reduce iron loss, it is effective to smoothly perform the domain wall motion. However, the forsterite film has an uneven structure in a steel sheet/insulation coating interface. Therefore, the domain wall motion is inhibited by the uneven structure which adversely affects iron loss.

In order to solve the problem, a technique of suppressing formation of a forsterite film and smoothing a steel sheet surface has been disclosed.

For example, Patent Documents 2 to 5 disclose a technique of controlling an atmosphere dew point of decarburization annealing and using alumina as an annealing separator so as to smooth a steel sheet surface without forming a forsterite film after final annealing.

However, when a steel sheet surface is smoothed as described above, in order to apply tension to the steel sheet, it is necessary to form an insulation coating having sufficient adhesion. As a method of forming a tension-insulation coating having sufficient adhesion, for example. Patent Document 6 discloses a method of forming a tension-insulation coating after forming an amorphous oxide layer on a steel sheet surface. In addition. Patent Documents 7 to 11 disclose a technique of controlling a structure of an amorphous oxide layer in order to form a tension-insulation coating having higher adhesion.

Patent Document 7 discloses a method of securing coating adhesion between a tension-insulation coating and a steel sheet. In this method, coating adhesion is secured by performing a pre-treatment on a smoothed steel sheet surface of a grain-oriented electrical steel sheet to introduce fine unevenness on the steel sheet surface, forming an externally oxidized layer thereon, and thus forming an externally oxidized granular oxide including silica as a main component to penetrate the thickness of the externally oxidized layer. As a result, coating adhesion between the tension-insulation coating and the steel sheet is secured.

Patent Document 8 discloses a method of securing coating adhesion between a tension-insulation coating and a steel sheet. In this method, in a heat treatment process for forming an externally oxidized layer on a smoothed steel sheet surface of a grain-oriented electrical steel sheet, a temperature rising rate in a temperature range of 200° C. to 1150° C. is controlled to be 10° C./sec to 500° C./sec such that a cross-sectional area fraction of a metal oxide of iron, aluminum, titanium, manganese, or chromium, or the like in the externally oxidized layer is 50% or less. As a result, coating adhesion between the tension-insulation coating and the steel sheet is secured.

Patent Document 9 discloses a method of securing coating adhesion between a tension-insulation coating and a steel sheet. In this method, in a process of forming a tension-insulation coating after forming an externally oxidized layer on a smoothed steel sheet surface of a grain-oriented electrical steel sheet, a contact time between the steel sheet with the externally oxidized layer and a coating solution for forming the tension-insulation coating is set to be 20 seconds or shorter such that a proportion of a low density layer in the externally oxidized layer is 30% or less. As a result, coating adhesion between the tension-insulation coating and the steel sheet is secured.

Patent Document 10 discloses a method of securing coating adhesion between a tension-insulation coating and a steel sheet. In this method, a heat treatment for forming an externally oxidized layer on a smoothed steel sheet surface of a grain-oriented electrical steel sheet is performed at a temperature of 1000° C. or higher, and a cooling rate in a temperature range of a temperature at which the externally oxidized layer is formed to 200° C. is controlled to be 100° C./sec or lower such that a cross-sectional area fraction of voids in the externally oxidized layer is 30% or lower. As a result, coating adhesion between the tension-insulation coating and the steel sheet is secured.

Patent Document 11 discloses a method of securing coating adhesion between a tension-insulation coating and a steel sheet. In this method, in a heat treatment process for forming an externally oxidized layer on a smoothed steel sheet surface of a grain-oriented electrical steel sheet, a heat treatment is performed under conditions of temperature range: 600° C. to 1150° C. and atmosphere dew point: −20° C. to 0° C. and cooling is performed after the heat treatment at an atmosphere dew point of 5° C. to 60° C. such that a cross-sectional area fraction of metallic iron in the externally oxidized layer is 5% to 30%. As a result, coating adhesion between the tension-insulation coating and the steel sheet is secured.

However, it may be difficult to sufficiently obtain the expected coating adhesion with the techniques of the related art.

PRIOR ART DOCUMENT

Patent Document

[Patent Document 1] Japanese Unexamined Patent Application, First Publication No. S48-039338

[Patent Document 2] Japanese Unexamined Patent Application, First Publication No. H7-278670

[Patent Document 3] Japanese Unexamined Patent Application, First Publication No. H11-106827

[Patent Document 4] Japanese Unexamined Patent Application, First Publication No. H11-118750

[Patent Document 5] Japanese Unexamined Patent Application, First Publication No. 2003-268450

[Patent Document 6] Japanese Unexamined Patent Application, First Publication No. H7-278833

[Patent Document 7] Japanese Unexamined Patent Application, First Publication No. 2002-322566

[Patent Document 8] Japanese Unexamined Patent Application, First Publication No. 2002-348643

[Patent Document 9] Japanese Unexamined Patent Application, First Publication No. 2003-293149

[Patent Document 10] Japanese Unexamined Patent Application, First Publication No. 2002-363763

[Patent Document 11] Japanese Unexamined Patent Application, First Publication No. 2003-313644

DISCLOSURE OF THE INVENTION

Problems to be Solved by the Invention

The present invention has been made in consideration of the current situation of the techniques of the related art, and an object thereof is to provide coating adhesion with a tension-insulation coating in a grain-oriented electrical steel sheet in which a steel sheet surface is smoothed without forming a forsterite film. That is, an object of the present invention is to provide a grain-oriented electrical steel sheet having excellent coating adhesion with a tension-insulation coating.

Means for Solving the Problem

The present inventors conducted a thorough investigation on a method for achieving the object. As a result, it was found that, in a grain-oriented electrical steel sheet in which an oxide layer and a tension-insulation coating including a chromium compound are formed on a steel sheet surface, by optimizing the Fe content in the tension-insulation coating, coating adhesion with the tension-insulation coating can be improved. The present invention has been made based on the above finding, and the scope thereof is as follows.

(1) According to one embodiment of the present invention, there is provided a grain-oriented electrical steel sheet according to an embodiment of the present invention including: a steel sheet; an oxide layer including $SiO_2$ that is formed on the steel sheet; and a tension-insulation coating that is formed on the oxide layer, in which the steel sheet includes, as a chemical composition, by mass %, C: 0.085% or less. Si: 0.80% to 7.00%, Mn: 1.00% or less, acid-soluble Al: 0.065% or less, S: 0.013% or less, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, the tension-insulation coating includes a chromium compound, and a Fe content in the oxide layer and the tension-insulation coating is 70 mg/m$^2$ to 250 mg/m$^2$.

(2) In the grain-oriented electrical steel sheet according to (1), the chemical composition of the steel sheet may include, by mass %, Cu: 0.01% to 0.80%.

Effects of the Invention

According to the aspect of the present invention, a tension-insulation coating having excellent coating adhesion can be formed on a smoothed steel sheet surface of a grain-oriented electrical steel sheet not including a forsterite film with an oxide layer interposed therebetween. That is, the grain-oriented electrical steel sheet having excellent coating adhesion can be provided.

EMBODIMENTS OF THE INVENTION

Figure 1:
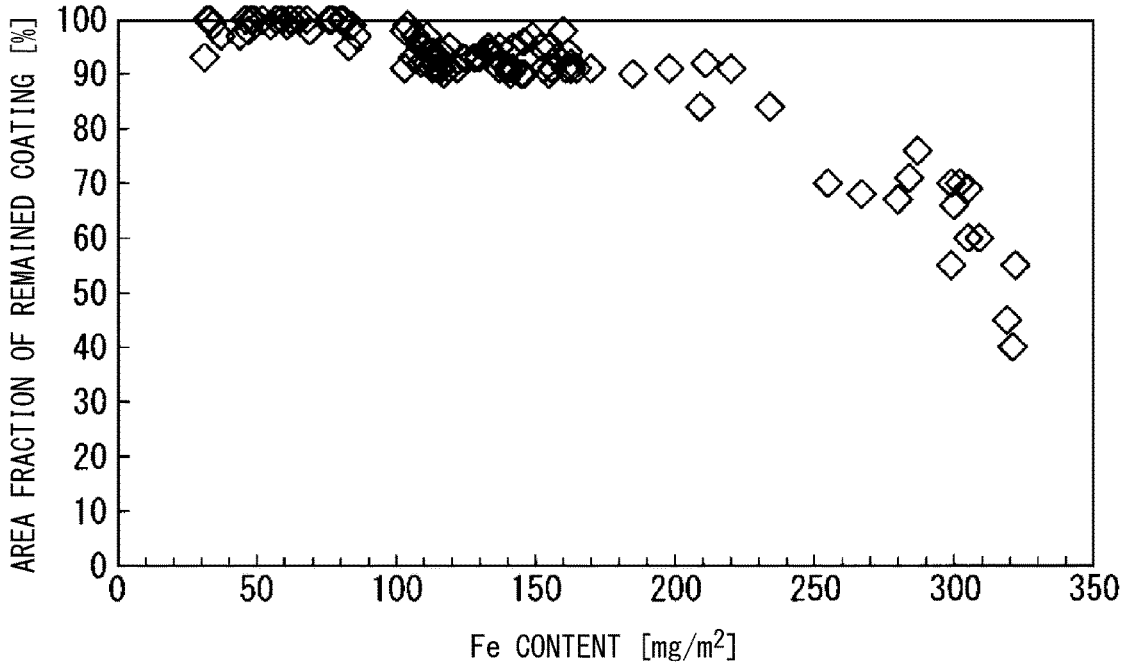
FIG. 1 is a diagram showing a relationship between a Fe content in a tension-insulation coating and an oxide layer, and an area fraction of remained coating.

A grain-oriented electrical steel sheet according to an embodiment of the present invention (hereinafter, referred to as "electrical steel sheet according to the embodiment") includes: a steel sheet; an oxide layer including $SiO_2$ that is formed on the steel sheet; and a tension-insulation coating that is formed on the oxide layer, in which the steel sheet includes, as a chemical composition, by mass %, C: 0.085% or less, Si: 0.80% to 7.00%, Mn: 1.00% or less, acid-soluble Al: 0.065% or less, S: 0.013% or less, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, the tension-insulation coating includes a chromium compound, and the Fe content in the oxide layer and the tension-insulation coating is 70 mg/m$^2$ to 250 mg/m$^2$.

Hereinafter, the electrical steel sheet according to the embodiment will be described.

<Oxide Layer and Tension-Insulation Coating>

The present inventors presumed that, when a tension-insulation coating is formed on a smoothed steel sheet surface of a grain-oriented electrical steel sheet not including a forsterite film, in order to secure excellent coating adhesion, it is important to form an oxide layer including $SiO_2$ that contributes as an adhesion layer for adhesion between the steel sheet and the tension-insulation coating, particularly an amorphous layer including $SiO_2$ and more preferably a substantially amorphous layer including $SiO_2$, in a process of baking the tension-insulation coating. Here, "amorphous" refers to a solid in which atoms or molecules are disordered without forming an ordered space lattice. Specifically, "amorphous" refers to a state where only a halo is detected and a specific peak is not detected in X-ray diffraction. In the grain-oriented electrical steel sheet according to the embodiment, it is preferable that the oxide layer essentially consists of only a substantially amorphous $SiO_2$.

When an internally oxidized amorphous oxide is formed, the position, in which the internally oxidized amorphous oxide is formed, may become a starting point of peeling and the tension-insulation coating peels off from the internally oxidized amorphous oxide. Therefore, it is preferable that morphology of the amorphous oxide is an externally oxidized layer. Here, as the internally oxidized amorphous oxide, an oxide in a state where the amorphous oxide is inserted into the steel sheet in an interface between the steel sheet and the amorphous oxide, and an amorphous oxide in which an aspect ratio representing a ratio between the length of the inserted portion in a depth direction and the length of a base of the inserted portion is 1.2 or higher is defined as an internally oxidized amorphous oxide.

In addition, along with the formation of amorphous $SiO_2$ as the coating, Fe that is originally present in the formation portion of the amorphous $SiO_2$ is diffused into the tension-insulation coating. Therefore, the inventors assumed that it is important to optimize the Fe content in the oxide layer and the tension-insulation coating, and the following experiment was performed to further perform an investigation.

In the electrical steel sheet according to the embodiment, the Fe content in a portion other than the steel sheet (base steel sheet), that is, in both portions of the oxide layer (amorphous $SiO_2$) and the tension-insulation coating will also be simply referred to as "the Fe content in the tension-insulation coating".

An annealing separator including alumina as a main component was applied to a decarburization annealed sheet having a thickness of 0.23 mm and including 3.4% of Si as a material for the experiment, and final annealing was performed thereon for secondary recrystallization. As a result, a grain-oriented electrical steel sheet not including a forsterite film was prepared.

A heat treatment was performed on the grain-oriented electrical steel sheet in an atmosphere including 25% of nitrogen and 75% of hydrogen and having a dew point of −30° C. to 5° C. for a soaking time of 10 seconds to form a coating including silica ($SiO_2$) as a main component on a steel sheet surface.

A coating solution including a phosphate, chromic acid, and colloidal silica as main components was applied to the surface (specifically, the surface of the oxide layer) of the grain-oriented electrical steel sheet including the amorphous oxide layer including $SiO_2$, and the steel sheet to which the coating solution was applied was baked at 850° C. for 100 seconds in an atmosphere including 3% to 97% of nitrogen and 3% to 97% of hydrogen and having a dew point of −30° C. to 30° C. to form a tension-insulation coating including the chromium compound. The coating adhesion of the coating was investigated.

When the chromium compound is not included, the corrosion resistance significantly deteriorates. Therefore, in the electrical steel sheet according to the embodiment, as the tension-insulation coating, a tension-insulation coating including a chromium compound was used. Although when at least a small amount of the chromium compound is included the effect thereof can be obtained, the amount of the chromium compound is preferably 1.0 g/m$^2$ or more.

The coating adhesion was evaluated by collecting a test piece from the steel sheet, winding the test piece around a cylinder having a diameter of 30 mm (180° bending), and obtaining an area fraction of the coating (hereinafter, referred to as "area fraction of remained coating") adhering to the steel sheet without being peeled off from the steel sheet in a state where the test piece was bent back.

Next, the steel sheet was dipped in a bromine-methanol solution to dissolve the base steel sheet and a residue was recovered to recover the oxide layer and the tension-insulation coating. The recovered residue was dissolved in perchloric acid and nitric acid, and the Fe content in the solution in which the residue was dissolved was analyzed by inductively coupled plasma (ICP)-optical emission spectrometry. The residue that was not sufficiently able to be dissolved was further dissolved in hydrochloric acid, and the Fe content was analyzed by ICP.

FIG. 1 shows a relationship between a Fe content and an area fraction of remained coating in the oxide layer and the tension-insulation coating, the relationship being analyzed by ICP. It can be seen from FIG. 1 that, in order to secure an area fraction of remained coating of 80% or higher, it is necessary that the Fe content is 250 mg/m$^2$ or less and that, in order to secure an area fraction of remained coating of 90% or higher, it is necessary that the Fe content is 200 mg/m$^2$ or less.

Further, in order to check insulating properties of the tension-insulation coating, the present inventors investigated a relationship between the Fe content in the oxide layer and the tension-insulation coating and an interlaminar current. The interlaminar current was measured according to a method defined in JIS C 2550.

Figure 2:
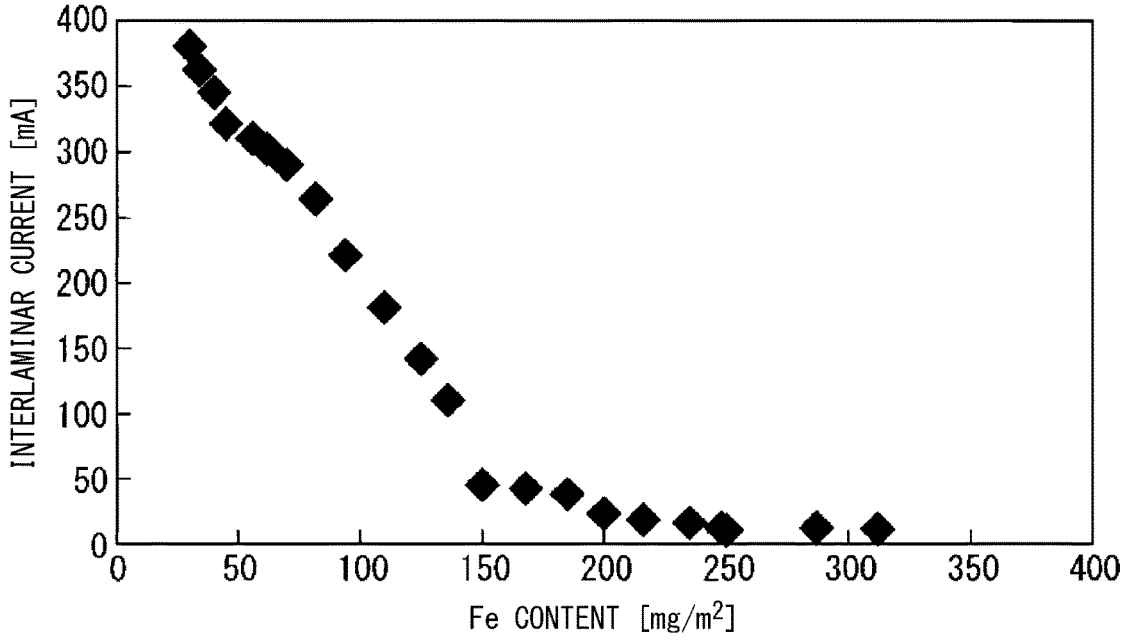
FIG. 2 is a diagram showing a relationship between a Fe content in the tension-insulation coating and the oxide layer and an interlaminar current.

FIG. 2 shows the measurement results. It can be seen from FIG. 2 that, when the Fe content in the oxide layer and the tension-insulation coating is less than 70 mg/m$^2$, the interlaminar current is higher than 300 mA and insulating properties are insufficient. In addition, it can be seen that when the Fe content in the oxide layer and the tension-insulation coating is 150 mg/m$^2$ or more, the interlaminar current is lower than 50 mA and excellent insulating properties can be secured. It also can be seen that, when the Fe content in the oxide layer and the tension-insulation coating is less than 70 mg/m$^2$, the steel sheet surface is discolored black.

The reason for the insufficient insulating properties and the black discoloration of the steel sheet surface is not clear but is presumed to be that a compound of conductive iron and phosphorus is formed. Accordingly, in order to secure adhesion and insulating properties in the tension-insulation coating, it is necessary that the Fe content in the oxide layer and the tension-insulation coating is 70 mg/m$^2$ to 250 mg/m$^2$. The Fe content is preferably 150 mg/m to 200 mg/m$^2$.

The coating weight of Si in the tension-insulation coating and the oxide layer in terms of $SiO_2$ is preferably less than 50% with respect to the total coating weight. When the coating weight of Si in terms of $SiO_2$ is 50% or more with respect to the total coating weight, the coating tension increases excessively, and the adhesion of the coating may deteriorate.

The coating weight of Si in terms of $SiO_2$ in the insulation coating and the oxide layer can be measured by inductively coupled plasma (ICP)-optical emission spectrometry using the same method as that of the measurement of the Fe content.

Since the oxide layer is thinner (~several nanometers) than the tension-insulation coating, the Fe content or the coating weight of Si in terms of $SiO_2$ in the insulation coating and the oxide layer is close to the Fe content or the coating weight of Si in terms of $SiO_2$ in the insulation coating.

<Component Composition>

Next, a chemical composition (component composition) of the electrical steel sheet according to the embodiment will be described. Hereinafter, "%" regarding the chemical composition represents "mass %".

C: 0.085% or Less

C is an element that significantly increases iron loss by magnetic aging. When the C content is more than 0.085%, an increase in iron loss is significant. Therefore, the C content is set to be 0.085% or less. The C content is preferably 0.010% or less and more preferably 0.005% or less. It is preferable that the C content is as less as possible from the viewpoint of reducing iron loss. Therefore, the lower limit is not particularly limited. However, since the detection limit is about 0.0001%, 0.0001% is the substantial lower limit of the C content.

Si: 0.80% to 7.00%

Si is an element that controls secondary recrystallization during secondary recrystallization annealing and contributes to improvement of magnetic characteristics. When the Si content is less than 0.80%, since phase transformation of the steel sheet occurs during secondary recrystallization annealing, it is difficult to control secondary recrystallization, and high magnetic flux density and iron loss characteristics cannot be obtained. Therefore, the Si content is set to be 0.80% or more. The Si content is preferably 2.50% or more and more preferably 3.00% or more.

On the other hand, when the Si content is more than 7.00%, the steel sheet becomes brittle, and passability significantly deteriorates in a manufacturing process. Therefore, the Si content is set to be 7.00% or less. The Si content is preferably 4.00% or less and more preferably 3.75% or less.

Mn: 1.00% or Less

When the Mn content is more than 1.00%, since phase transformation of the steel sheet occurs during secondary recrystallization annealing, good magnetic flux density and iron loss characteristics cannot be obtained. Therefore, the Mn content is set to be 1.00% or lower. The Mn content is preferably 0.70% or less and more preferably 0.50% or less.

On the other hand, Mn is an austenite-forming element and is also an element that controls secondary recrystallization during secondary recrystallization annealing and contributes to improvement of magnetic characteristics. When the Mn content is less than 0.01%, the steel sheet becomes brittle during hot rolling. Therefore, the Mn content is preferably 0.01% or more. The Mn content is preferably 0.05% or more and more preferably 0.10% or more.

Acid-Soluble Al: 0.065% or Less

When the acid-soluble Al content is more than 0.065%, precipitation dispersion of AlN becomes non-uniform, a desired secondary recrystallization structure cannot be obtained, the magnetic flux density decreases, and the steel sheet becomes brittle. Therefore, the acid-soluble Al content is set to be 0.065% or less. The acid-soluble Al content is preferably 0.060% or less and more preferably 0.050% or less.

On the other hand, the acid-soluble Al is an element that binds to N to form (Al,Si)N functioning as an inhibitor. When the acid-soluble Al content is less than 0.010%, the amount of AlN formed decreases, and secondary recrystallization may progress insufficiently. Therefore, the acid-soluble Al content is preferably 0.010% or more. The acid-soluble Al content is more preferably 0.015% or more and still more preferably 0.020% or more.

S: 0.013% or Less

S is an element that binds to Mn to form MnS functioning as an inhibitor. When the S content is more than 0.013%, a small sulfide is formed, and iron loss characteristics deteriorate. Therefore, the S content is 0.013% or less. The S content is preferably 0.010% or less and more preferably 0.007% or less.

It is preferable that the S content is as less as possible. Therefore, the lower limit is not particularly limited. However, since the detection limit is about 0.0001%, 0.0001% is the substantial lower limit of the S content. From the viewpoint of forming a required amount of MnS functioning as an inhibitor, the S content is preferably 0.003% or more and more preferably 0.005% or more.

In order to improve characteristics, the component composition of the electrical steel sheet according to the embodiment may include Cu: 0.01% to 0.80% in addition to the above-described elements. In addition, within a range where the characteristic of the electrical steel sheet according to the embodiment do not deteriorate, the electrical steel sheet according to the embodiment may include at least one selected from the group consisting of N: 0.001% to 0.012%, P: 0.50% or less, Ni: 1.00% or less, Sn: 0.30% or less, and Sb: 0.30% or less. However, since it is not necessary that the electrical steel sheet includes these elements, the lower limits thereof are 0%.

Cu: 0% to 0.80%

Cu is an element that binds to S to form CuS functioning as an inhibitor. When the Cu content is less than 0.01%, the effect is not sufficiently exhibited. Therefore, the Cu content is 0.01% or more. The Cu content is preferably 0.04% or more and more preferably 0.07% or more.

On the other hand, when the Cu content is more than 0.80%, dispersion of precipitates becomes non-uniform, and the effect of reducing iron loss is saturated. Therefore, the Cu content is 0.80% or less. The Cu content is preferably 0.60% or less and more preferably 0.45% or less.

N: 0% to 0.012%

N is an element that hinds to Al to form AlN functioning as an inhibitor. When the N content is less than 0.001%, formation of AlN is not sufficient. Therefore, the N content is preferably 0.001% or more. The N content is more preferably 0.006% or more.

On the other hand, N is also an element that forms blisters (voids) in the steel sheet during cold rolling. When the N content is more than 0.012%, blisters (voids) may be formed in the steel sheet during cold rolling. Therefore, the N content is preferably 0.012% or less. The N content is more preferably 0.010% or less.

P: 0% to 0.50%

P is an element that increases the specific resistance of the steel sheet to contribute to a decrease in iron loss. The lower limit may be 0%, but from the viewpoint of reliably obtaining the effect, the P content is preferably 0.02% or more.

On the other hand, when the P content is more than 0.50%, rollability deteriorates. Therefore, the P content is preferably 0.50% or less. The P content is more preferably 0.35% or less.

Ni: 0% to 1.00%

Ni is an element that increases the specific resistance of the steel sheet to contribute to a decrease in iron loss and controls the metallographic structure of the hot-rolled steel sheet to contribute to improvement of magnetic characteristics. The lower limit may be 0%, but from the viewpoint of reliably obtaining the effect, the Ni content is preferably 0.02% or more. When the Ni content is more than 1.00%, secondary recrystallization progresses unstably. Therefore, the Ni content is preferably 1.00% or less. The Ni content is more preferably 0.75% or less.

Sn: 0% to 0.30%

Sb: 0% to 0.30%

Sn and Sb are elements that segregate in a grain boundary and function to prevent Al from being oxidized by water emitted from the annealing separator during final annealing (due to this oxidation, the inhibitor intensity varies depending on coil positions, and magnetic characteristics vary). The lower limit may be 0%, but from the viewpoint of reliably obtaining the effect, the amount of any of the elements is preferably 0.02% or more.

On the other hand, when the amount of any of the elements is more than 0.30%, secondary recrystallization becomes unstable, and magnetic characteristics deteriorate. Therefore, the amount of any of Sn and Sb is preferably 0.30% or less. The amount of any of the elements is more preferably 0.25% or less.

The remainder in the electrical steel sheet according to the embodiment other than the above-described elements are Fe and impurities. The impurities are elements that are unavoidably incorporated from steel raw materials and/or in the steelmaking process.

<Manufacturing Method>

Next, a method for manufacturing the electrical steel sheet according to the embodiment will be described.

Molten steel having a required chemical composition is cast using a typical method, and this slab is provided for typical hot rolling to form a hot-rolled steel sheet (material of the grain-oriented electrical steel sheet). Next, hot-band annealing is performed on this hot-rolled steel sheet, and cold rolling is performed once or cold rolling is performed multiple times while performing intermediate annealing therebetween. As a result, a steel sheet having the same thickness as that of a final product is obtained. Next, decarburization annealing is performed on the cold-rolled steel sheet.

It is preferable that decarburization annealing is performed in a wet hydrogen atmosphere. By performing a heat treatment in the above-described atmosphere, the C content in the steel sheet is reduced even in a region where deterioration of magnetic characteristics caused by magnetic aging does not occur in the steel sheet as a product, and concurrently the metallographic structure can be primarily recrystallized. This primary recrystallization is a preparation for secondary recrystallization.

After decarburization annealing, the steel sheet is annealed in an ammonia atmosphere to form AlN as an inhibitor.

Next, final annealing is performed at a temperature of 1100° C. or higher. Final annealing is performed on the steel sheet coiled in the form of a coil after applying an annealing separator including $Al_2O_3$ as a main component to the steel sheet surface in order to prevent seizure of the steel sheet.

After completion of final annealing, the redundant annealing separator is removed using a scrubber and controls the surface state of the steel sheet. When the redundant annealing separator is removed, it is preferable that cleaning with water is performed while performing a treatment using a scrubber.

With respect to the scrubber, the reduction of a brush is controlled to be preferably 1.0 mm and 5.0 mm.

It is not preferable that the reduction of the brush is less than 1.0 mm because the redundant annealing separator cannot be sufficiently removed and the coating adhesion deteriorates. In addition, it is not preferable that the reduction of the brush is more than 5.0 mm because the steel sheet surface is cut more than necessary, the surface activity increases, the elution amount of iron is excessively large, the Fe content in the coating is excessively large, and the coating adhesion deteriorates.

Next, the steel sheet is annealed in a mixed atmosphere of hydrogen and nitrogen to form an oxide layer. An oxygen partial pressure ($P_{H2O}/P_{H2}$) in a vapor mixed atmosphere forming the oxide layer is preferably 0.005 or lower and more preferably 0.001 or lower. In addition, a holding temperature is preferably 600° C. to 1150° C. and more preferably 700° C. to 900° C. Under these conditions, an oxide layer including amorphous $SiO_2$ is formed.

When the oxygen partial pressure is higher than 0.005, an iron oxide other than the amorphous oxide layer is formed, and coating adhesion deteriorates. In addition, when the holding temperature is lower than 600° C. the amorphous oxide is not likely to be sufficiently formed. In addition, it is not preferable that the annealing temperature is higher than 1150° C. because the facility load is not high.

When the morphology of the oxide layer is controlled to an externally oxidized layer having an aspect ratio of lower than 1.2, the oxygen partial pressure during cooling of annealing for forming the oxide layer is set to be preferably 0.005 or lower.

The grain-oriented electrical steel sheet having excellent magnetic characteristics (the electrical steel sheet according to the embodiment) can be obtained by applying a tension-insulation coating including aluminum phosphate, chromic acid, and colloidal silica on the steel sheet on which the oxide layer is formed and baking the tension-insulation coating at 835° C. to 870° C. for 20 to 100 seconds in an atmosphere including 3% to 97% of nitrogen and 3% to 97% of hydrogen and having an oxygen partial pressure of 0.0005 to 1.46.

EXAMPLES

Next, examples of the present invention will be described. However, the conditions are merely exemplary examples which confirm the operability and the effects of the present invention, and the present invention is not limited to these condition examples. The present invention can adopt various conditions within a range not departing from the scope of the present invention as long as the object of the present invention can be achieved under the conditions.

Example 1

Each of silicon steel slabs having component compositions shown in Table 1 was heated to 1100° C. and was hot-rolled to form a hot-rolled steel sheet having a thickness of 2.6 mm. After annealing the hot-rolled steel sheet at 1100° C., cold rolling was performed once or cold rolling was performed multiple times while performing intermediate annealing therebetween. As a result, a cold-rolled steel sheet having a final thickness of 0.23 mm was formed.

TABLE 1

| Steel No. | Chemical Composition (mass %) | | | | | | | | | | |
|---|---|---|---|---|---|---|---|---|---|---|---|
| | C | Si | Mn | Al | S | Cu | N | P | Ni | Sb | Sn |
| A | 0.007 | 0.80 | 0.01 | 0.015 | 0.005 | 0.01 | 0 | 0 | 0 | 0 | 0 |
| B | 0.011 | 3.75 | 1.01 | 0.020 | 0.013 | 0.02 | 0.008 | 0 | 0 | 0 | 0 |
| C | 0.003 | 2.50 | 0.50 | 0.030 | 0.002 | 0.24 | 0.010 | 0.20 | 0 | 0 | 0 |
| D | 0.003 | 3.79 | 1.50 | 0.026 | 0.003 | 0.04 | 0.012 | 0.30 | 0.80 | 0 | 0 |
| E | 0.085 | 6.50 | 0.20 | 0.050 | 0.0008 | 0.03 | 0.012 | 0.40 | 0.90 | 0.20 | 0 |
| F | 0.008 | 7.00 | 0.80 | 0.065 | 0.0007 | 0.07 | 0.012 | 0.50 | 1.00 | 0.30 | 0.30 |

Next, decarburization annealing and nitriding annealing were performed on the cold-rolled steel sheet. Next, a water slurry of an annealing separator including alumina as a main component was applied. Next, final annealing was performed at 1200° C. for 20 hours. As a result, a grain-oriented electrical steel sheet having specular glossiness not including a forsterite film on which secondary recrystallization was completed was obtained.

Soaking was performed on the steel sheet at 800° C. for 30 seconds in an atmosphere including 25% of nitrogen and 75% of hydrogen and having an oxygen partial pressure shown in Table 2. Next, the steel sheet was cooled to a room temperature in an atmosphere including 25% of nitrogen and 75% of hydrogen and having an oxygen partial pressure shown in Table 2. When the holding temperature of annealing was 600° C. or higher, a coating was formed on the steel sheet surface.

The formed coating was verified by X-ray diffraction and TEM. In addition. FT-IR was also used for the verification.

Specifically, with a combination of each of Steels No. on which the coating was formed and manufacturing conditions No., a cross-section of the steel sheet was processed by focused ion beam (FIB), and a 10 μm×10 μm range was observed with a transmission electron microscope (TEM). As a result, it was verified that the coating was formed of $SiO_2$. In addition, when the surface was analyzed by Fourier transform infrared spectroscopy (FT-IR), a peak was present at a wavenumber position of 1250 ($cm^{-1}$). Since this peak was derived from $SiO_2$, it was also able to verify that the coating was formed of $SiO_2$ from this peak. In addition, when X-ray diffraction was performed on the steel sheet including the coating, only halo was detected except for a peak of base metal, and a specific peak was not detected.

That is, all the formed coatings were the amorphous oxide layers composed of $SiO_2$.

A solution for forming a tension-insulation coating including aluminum phosphate, chromic acid, and colloidal silica was applied to the grain-oriented electrical steel sheet on which the amorphous oxide layer was formed, and was baked at a baking temperature shown in Table 2 and for a baking time shown in Table 2 in an atmosphere including 10% to 30% of nitrogen and 70% to 90% of hydrogen and having an oxygen partial pressure shown in Table 2 to form a tension-insulation coating.

In addition, the blending ratio of the coating solution was adjusted such that the coating weight of Si in terms of $SiO_2$ in the tension-insulation coating was less than 50% with respect to the total coating weight.

A test piece was collected from the grain-oriented electrical steel sheet on which the tension-insulation coating was formed, and the test piece was wound around a cylinder having a diameter of 30 mm (180° bending), and was bent back. At this time, an area fraction of remained coating was obtained, and coating adhesion with the insulation coating was evaluated based on the area fraction of remained coating. In the evaluation of the adhesion with the insulation coating, whether or not the tension-insulation coating was peeled off was determined by visual inspection. A case where the tension-insulation coating was not peeled off from the steel sheet and the area fraction of remained coating was 90% or higher was evaluated as "GOOD", and a case where the area fraction of remained coating was 80% or higher and lower than 90% was evaluated as "OK", and a case where the area fraction of remained coating was lower than 80% was evaluated as "NG".

Next, in order to measure the Fe content in the tension-insulation coating and the oxide layer, the steel sheet was dipped in a bromine-methanol solution to dissolve the base steel sheet and a residue was recovered. The recovered residue was dissolved in perchloric acid and nitric acid, and the Fe content in the solution in which the residue was dissolved was analyzed by ICP. The residue that was not sufficiently able to be dissolved was further dissolved in hydrochloric acid, and the Fe content was analyzed by ICP. The results of the evaluation of the Fe content and the adhesion with the insulation coating are shown in Table 2.

The interlaminar current was measured according to JIS C 2550. The interlaminar current is also shown in Table 2.

TABLE 2

| | Manufacturing Conditions | | | | | | |
|---|---|---|---|---|---|---|---|
| | | Annealing for Forming Oxide Layer | | | Formation of Tension Insulation Coating | | |
| | Scrubber Reduction [mm] | Oxygen Partial Pressure | Holding Temperature (° C.) | Oxygen Partial Pressure during Cooling | Oxygen Partial Pressure | Baking Temperature [° C.] | Baking Time [sec] |
| 1 | 1.0 | 0.005 | 600 | 0.005 | 0.005 | 835 | 10 |
| 2 | 5.5 | 0.001 | 800 | 0.001 | 0.005 | 840 | 100 |
| 3 | 0.6 | 0.008 | 1150 | 0.008 | 0.008 | 855 | 100 |
| 4 | 0.8 | 0.007 | 850 | 0.007 | 1.52 | 850 | 100 |

TABLE 2-continued

| | | | | | | | |
|---|---|---|---|---|---|---|---|
| 5 | 5.5 | 0.004 | 500 | 0.004 | 0.004 | 800 | 100 |
| 6 | 6.0 | 0.0008 | 550 | 0.0008 | 0.001 | 865 | 100 |
| 7 | 1.0 | 0.001 | 500 | 0.001 | 0.0005 | 860 | 100 |
| 8 | 1.5 | 0.010 | 450 | 0.010 | 0.004 | 855 | 100 |
| 9 | 3.5 | 0.006 | 830 | 0.006 | 0.0005 | 850 | 100 |
| 10 | 5.0 | 0.009 | 680 | 0.009 | 0.0008 | 860 | 100 |
| 11 | 1.5 | 0.004 | 600 | 0.004 | 0.005 | 870 | 100 |
| 12 | 2.5 | 0.002 | 640 | 0.002 | 0.004 | 840 | 100 |
| 13 | 3.5 | 0.003 | 690 | 0.003 | 0.003 | 845 | 100 |
| 14 | 2.5 | 0.0009 | 835 | 0.0009 | 0.006 | 850 | 100 |
| 15 | 3.5 | 0.0005 | 850 | 0.0005 | 0.0006 | 855 | 100 |
| 16 | 4.5 | 0.0003 | 870 | 0.0003 | 0.0008 | 860 | 100 |
| 17 | 5.0 | 0.0004 | 880 | 0.0004 | 0.001 | 850 | 100 |

| | Evaluation of Characteristics | | | | | |
|---|---|---|---|---|---|---|
| | Steel No. A | | | Steel No. B | | |
| | Fe Content [mg/m$^2$] | Coating Adhesion | Interlaminar Current [mA] | Fe Content [mg/m$^2$] | Coating Adhesion | Interlaminar Current [mA] |
| 1 | 100 | NG | 180 | 90 | NG | 220 |
| 2 | 180 | NG | 45 | 190 | NG | 20 |
| 3 | 50 | NG | 320 | 40 | NG | 310 |
| 4 | 60 | NG | 310 | 45 | NG | 380 |
| 5 | 50 | NG | 320 | 50 | NG | 340 |
| 6 | 260 | NG | 30 | 280 | NG | 20 |
| 7 | 60 | NG | 310 | 50 | NG | 320 |
| 8 | 55 | NG | 320 | 45 | NG | 340 |
| 9 | 40 | NG | 320 | 35 | NG | 325 |
| 10 | 35 | NG | 310 | 40 | NG | 340 |
| 11 | 80 | OK | 280 | 100 | OK | 260 |
| 12 | 120 | OK | 80 | 140 | OK | 60 |
| 13 | 130 | OK | 60 | 120 | OK | 110 |
| 14 | 150 | GOOD | 45 | 180 | GOOD | 40 |
| 15 | 160 | GOOD | 40 | 170 | GOOD | 35 |
| 16 | 160 | GOOD | 25 | 175 | GOOD | 25 |
| 17 | 185 | GOOD | 15 | 180 | GOOD | 20 |

| | Evaluation of Characteristics | | | | | | | | |
|---|---|---|---|---|---|---|---|---|---|
| | | | | Steel No. D | | | Steel No. E | | |
| | Fe Content [mg/m$^2$] | Coating Adhesion | Interlaminar Current [mA] | Fe Content [mg/m$^2$] | Coating Adhesion | Interlaminar Current [mA] | Fe Content [mg/m$^2$] | Coating Adhesion | Interlaminar Current [mA] |
| 1 | 120 | NG | 120 | 130 | NG | 110 | 140 | NG | 100 |
| 2 | 180 | NG | 25 | 170 | NG | 35 | 160 | NG | 40 |
| 3 | 45 | NG | 330 | 60 | NG | 320 | 55 | NG | 360 |
| 4 | 55 | NG | 400 | 65 | NG | 380 | 60 | NG | 360 |
| 5 | 45 | NG | 310 | 60 | NG | 350 | 55 | NG | 340 |
| 6 | 270 | NG | 10 | 255 | NG | 15 | 260 | NG | 25 |
| 7 | 45 | NG | 340 | 65 | NG | 330 | 60 | NG | 310 |
| 8 | 40 | NG | 360 | 60 | NG | 350 | 65 | NG | 340 |
| 9 | 40 | NG | 335 | 45 | NG | 385 | 55 | NG | 345 |
| 10 | 35 | NG | 310 | 45 | NG | 345 | 50 | NG | 360 |
| 11 | 120 | OK | 150 | 110 | OK | 190 | 100 | OK | 220 |
| 12 | 130 | OK | 65 | 120 | OK | 70 | 110 | OK | 160 |
| 13 | 115 | OK | 120 | 125 | OK | 80 | 110 | OK | 95 |
| 14 | 200 | GOOD | 10 | 160 | GOOD | 45 | 180 | GOOD | 20 |
| 15 | 170 | GOOD | 20 | 165 | GOOD | 40 | 185 | GOOD | 15 |
| 16 | 185 | GOOD | 25 | 190 | GOOD | 25 | 185 | GOOD | 10 |
| 17 | 195 | GOOD | 15 | 180 | GOOD | 30 | 175 | GOOD | 30 |

| | Evaluation of Characteristics Steel No. F | | | |
|---|---|---|---|---|
| | Fe Content [mg/m$^2$] | Coating Adhesion | Interlaminar Current [mA] | Note |
| 1 | 120 | NG | 140 | Comparative Example |
| 2 | 165 | NG | 35 | Comparative Example |
| 3 | 48 | NG | 380 | Comparative Example |
| 4 | 60 | NG | 350 | Comparative Example |
| 5 | 55 | NG | 360 | Comparative Example |

TABLE 2-continued

| | | | | |
|---|---|---|---|---|
| 6 | 270 | NG | 15 | Comparative Example |
| 7 | 65 | NG | 350 | Comparative Example |
| 8 | 55 | NG | 320 | Comparative Example |
| 9 | 45 | NG | 350 | Comparative Example |
| 10 | 40 | NG | 345 | Comparative Example |
| 11 | 115 | OK | 140 | Example |
| 12 | 80 | OK | 280 | Example |
| 13 | 120 | OK | 60 | Example |
| 14 | 170 | GOOD | 40 | Example |
| 15 | 200 | GOOD | 10 | Example |
| 16 | 195 | GOOD | 15 | Example |
| 17 | 165 | GOOD | 35 | Example |

INDUSTRIAL APPLICABILITY

As described above, according to the present invention, a tension-insulation coating having excellent coating adhesion can be formed on a smoothed steel sheet surface of a grain-oriented electrical steel sheet not including a forsterite film, and the grain-oriented electrical steel sheet with the tension-insulation coating having excellent coating adhesion can be provided. Accordingly, the present invention is highly applicable to the industries of manufacturing electrical steel sheets.

What is claimed is:

1. A grain-oriented electrical steel sheet comprising:

a steel sheet;

an oxide layer including $SiO_2$ that is formed on the steel sheet; and a tension-insulation coating that is formed on the oxide layer, wherein the steel sheet includes, as a chemical composition, by mass %, C: 0.085% or less, Si: 0.80% to 7.00%, Mn: 1.00% or less, acid-soluble Al: 0.065% or less, S: 0.013% or less, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, the tension-insulation coating includes a chromium compound, and a Fe content in the oxide layer and the tension-insulation coating is 70 $mg/m^2$ to 250 $mg/m^2$.

2. The grain-oriented electrical steel sheet according to claim 1, wherein the chemical composition of the steel sheet includes, by mass %, Cu: 0.01% to 0.80%.

* * * * *